US010399213B2

(12) United States Patent
Wang

(10) Patent No.: US 10,399,213 B2
(45) Date of Patent: Sep. 3, 2019

(54) ADJUSTABLE WRENCH

(71) Applicants: Hangzhou Great Star Tools Co., Ltd., Hangzhou (CN); Hangzhou Great Star Industrial Co., Ltd., Hangzhou (CN)

(72) Inventor: Min Wang, Hangzhou (CN)

(73) Assignees: Hangzhou Great Star Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 103 days.

(21) Appl. No.: 15/546,825

(22) PCT Filed: Jan. 28, 2015

(86) PCT No.: PCT/CN2015/071684
§ 371 (c)(1),
(2) Date: Jul. 27, 2017

(87) PCT Pub. No.: WO2016/119134
PCT Pub. Date: Aug. 4, 2016

(65) Prior Publication Data
US 2018/0015593 A1 Jan. 18, 2018

(51) Int. Cl.
*B25B 13/14* (2006.01)
*B25B 13/46* (2006.01)

(52) U.S. Cl.
CPC ..... *B25B 13/14* (2013.01); *B25B 13/46* (2013.01); *B25B 13/463* (2013.01)

(58) Field of Classification Search
CPC ..... B25B 13/14; B25B 13/46; B25B 13/463; B25B 13/48; B25B 13/481; B25B 13/5091; B25B 17/00; E21B 19/16
See application file for complete search history.

(56) References Cited

U.S. PATENT DOCUMENTS

| | | | | |
|---|---|---|---|---|
| 6,789,447 | B1 | 9/2004 | Zinck | |
| 7,587,961 | B1 | 9/2009 | Chiang | |
| 7,765,897 | B2 | 8/2010 | Kim et al. | |
| 7,997,168 | B2 * | 8/2011 | Kinskey | B25B 13/463 81/163 |
| 2006/0196317 | A1 | 9/2006 | Kinskey | |
| 2009/0277309 | A1 | 11/2009 | Shen et al. | |
| 2014/0260818 | A1 * | 9/2014 | Chiang | B25B 13/463 81/63 |

FOREIGN PATENT DOCUMENTS

| | | | |
|---|---|---|---|
| CN | 101171100 | A | 4/2008 |
| CN | 101554717 | A | 10/2009 |
| CN | 202241022 | U | 5/2012 |
| GB | 2041272 | A | 9/1980 |
| WO | 2014110776 | A1 | 7/2014 |

* cited by examiner

*Primary Examiner* — Robert J Scruggs
(74) *Attorney, Agent, or Firm* — The Webb Law Firm

(57) ABSTRACT

Disclosed is an adjustable wrench including a handle and a working portion. The working portion includes an adjusting device and at least two jaws. The jaws are distributed along the circumferential direction of the working portion, and the adjusting device is arranged such as to adjust the jaws to simultaneously move in a radial direction of the working portion, closer to or away from the center of the working portion, that is, the jaw opening defined by the plurality of jaws are adjustable. The adjustable wrench provided by the invention is adapted for workpieces of various specifications, and can realize rapid adjustment.

18 Claims, 6 Drawing Sheets

ADJUSTABLE WRENCH

CROSS-REFERENCE TO RELATED APPLICATION

This application is the United States national phase of International Application No. PCT/CN2015/071684 filed Jan. 28, 2015, the disclosure of which is hereby incorporated in its entirety by reference.

FIELD OF THE INVENTION

The invention relates to a hand tool, and more particularly to an adjustable wrench.

DESCRIPTION OF THE PRIOR ART

A hand tool such as a wrench generally includes a handle and jaws that are fixedly mounted to the handle. The jaws may extend along the direction of the handle or along the direction perpendicular to the handle. A plurality of jaws may form a jaw opening fitting with a workpiece. In practice, one often needs to deal with workpieces of different specifications and types, and only the wrenches of the corresponding type can be used stably and efficiently to fit with the workpiece. If the jaw opening of the wrench does not fit with a workpiece, the wrench cannot be used or would come loose in use, so usually a wrench of a corresponding type needs to be selected according to the specific dimensions of a workpiece. Various hand tools of various different types are often prepared due to different models and types of workpieces, which is very inconvenient.

U.S. Pat. No. 7,997,168 B2 had disclosed an adjustable ratchet wrench for tightening or loosening bolts and nuts, comprising a pair of movable jaws and an adjustment device. The adjustable ratchet wrench mainly uses a thumb wheel to actuate the gear shaft to rotate so that the movable jaws can move toward or away from each other along the gear shaft, realizing the adjustment of the size of the jaw opening formed by the jaws to accommodate different types of bolts or nuts. While this adjustable ratchet wrench realizes the adjustment function for jaws, it has very poor practicability. Firstly, the operation of the thumb wheel is not convenient, secondly, the stability of the transmission mechanism of itself is poor, and thirdly, the pair of jaws adjusted by the gear shaft is not secured in use.

Therefore, the person skilled in the art has been endeavoring to develop an adjustable wrench with high stability and dimension-adjustable jaw opening, which can be conveniently operated.

SUMMARY OF THE INVENTION

In light of the above defects in the prior art, the technical problem to be solved by the invention is to provide an adjustable wrench with high stability that can be operated conveniently, realizing adjustable jaw opening of the wrench and tightly securing the jaws with a workpiece.

To realize the above object, the present invention provides an adjustable wrench, comprising a handle and a working portion, the handle has a first end and a second end opposite the first end, the second end has a head portion for receiving the working portion, the working portion comprises at least two jaws distributed in a circumferential direction along the working portion and extending along an axial direction of the working portion, the adjustable wrench further comprises an adjusting device configured to adjust the jaws so as to enable the jaws to move simultaneously in a radial direction of the working portion, closer to or away from the center of the working portion.

In a further embodiment, the working portion further comprises a base, the jaws being configured to be slidable on the base, the jaws having a clamping surface; the handle actuating the base to rotate, the base actuating the jaws to rotate about the axis of the base, the jaws outputting torque by the clamping surface.

In a further embodiment, a groove portion is provided on the base, the groove portion being configured to be able to fit with the jaws, so that the jaws are movable along the groove portion.

In a further embodiment, the adjusting device comprises a knob and a connecting member, the knob being coaxial with the base, the direction of the connecting member being perpendicular to the axis of the knob, the knob and the connecting member having tapered toothed surfaces that can fit with each other, the knob driving the connecting member to rotate by the tapered toothed surface; the connecting member passing through the jaw, wherein the outer thread of the connecting member fits with the inner threads of the jaws so that the jaws are actuated to move along the groove portion when the connecting member rotates.

In another embodiment, the adjusting device comprises a knob and a connecting member, the knob and the base being coaxial, the axis of the connecting member being perpendicular to the axis of the knob, the knob and the connecting member having tapered toothed surfaces that can fit with each other, the jaw having a stem portion, the stem portion having an outer thread fitting with the connecting member, the jaw being actuated to move along the groove portion when the connecting member rotates.

In another embodiment, the adjusting device is a knob, the lower end surface of the knob having a planar thread structure, the upper end surface of the jaw having an arcuate toothed surface, the planar thread structure fitting with the arcuate toothed surface so that the jaw is actuated to move along the groove portion when the knob rotates.

In a further embodiment, the working portion further comprises a reversing device, the reversing device comprising a pawl element fitting with the teeth of the ratchet surface of the base, so that the pawl element can selectively actuate the base to rotate in a first direction or a second direction, and to slip in the other direction, the first direction being clockwise direction or counterclockwise direction, the second direction being opposed to the first direction; a reversing switch for switching the direction in which the pawl element actuates the base to rotate; the handle having a first space for accommodating the reversing device.

In a further embodiment, the reversing switch comprises a spring and a blocking member, the handle having a second space for accommodating the spring, the second space connecting with the first space at the side facing toward the working portion, the blocking member fitting with the pawl element, the spring applying pre-tightening force to the pawl element by the blocking member.

In a further embodiment, the spring is arranged inside the blocking member.

In a further embodiment, the reversing switch further comprises a switch paddle connected to the pawl element.

In a further embodiment, the base comprises a first rotary member and a second rotary member, the first rotary member and the second rotary member being connected by bolt, the first rotary member having a ratchet surface fitting with the pawl element, the groove portion being located on the second rotary member.

In a further embodiment, the working portion has no less than two jaws.

In a further embodiment, the working portion has three jaws.

In a further embodiment, the jaws are I-shaped, embedded in the groove portion of the base.

In a further embodiment, the clamping surface can selectively be configured as an inner side surface and an outer side surface of the jaw.

In a further embodiment, the clamping surface is a V-shaped surface.

In a further embodiment, the clamping surface is an irregular shaped surface.

In a further embodiment, the base and the knob have a through hole in the direction of the central axis thereof.

In a further embodiment, a lower edge of the inner side surface of the handle limits the jaw in the groove portion.

In a further embodiment, the jaws are uniformly distributed along the circumferential direction of the working portion.

In a further embodiment, the jaws are used for clamping a workpiece, such as fasteners like a bolt, a nut or the like.

The adjustable wrench of the present invention realizes adjustable jaw opening between the jaws, and the jaws can be tightly connected to the workpiece. The operation is convenient with rapid adjustment, high stability and self-lock function, effectively preventing the jaw from coming loose during rotation of the wrench actuating the workpiece after clamping the workpiece.

Referencing now to the figures, the conception, detailed structure and induced technical effect of the present invention will be expounded for due understanding of the purpose, characterizations and effects of the present invention.

DETAILED DESCRIPTION OF THE PREFERRED EMBODIMENTS

Embodiment 1

Figure 1:
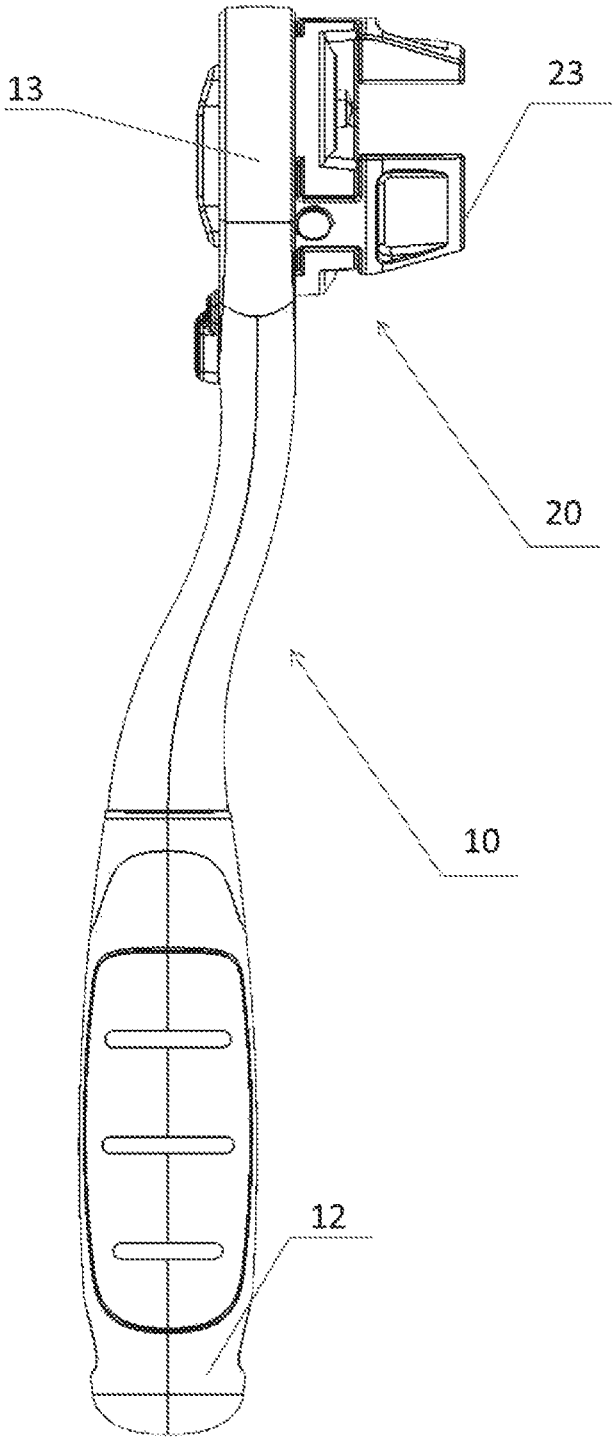
FIG. 1 is a front view of an adjustable wrench in Embodiment 1 of the present invention.

As shown in FIG. 1, the adjustable wrench of the present invention includes a handle 10 and a working portion 20. The handle 10 has a first end 12 and a second end 13 opposite the first end 12. The second end 13 has a head portion 11 (see FIG. 2) and is connected to the working portion 20. Jaws 23 are provided on the working portion and are adapted for operation of various types of workpieces by being configured into different shapes. The adjustable wrench of the present invention may have two or more jaws. Preferably, there are three jaws in this embodiment, which are distributed along the circumferential direction of the working portion 20.

Figure 2:
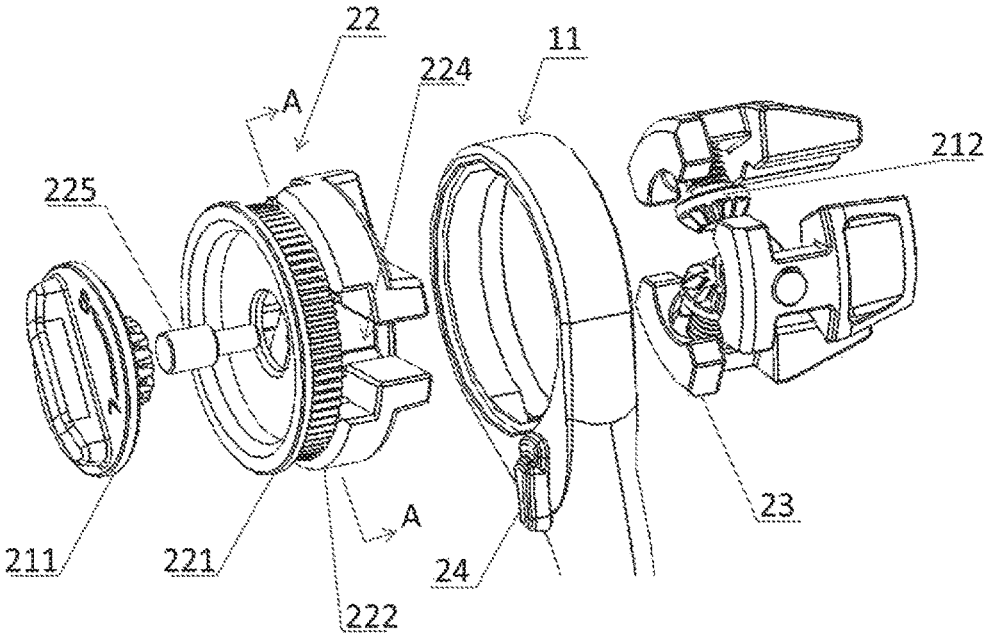
FIG. 2 illustrates the working portion of the adjustable wrench in Embodiment 1 of the present invention.
Figure 3:
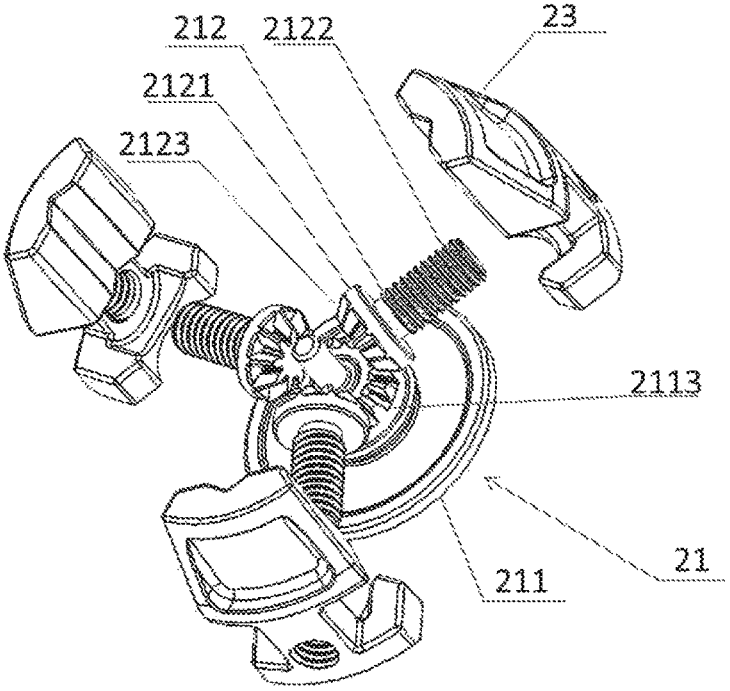
FIG. 3 illustrates the adjusting device and the jaws of the adjustable wrench in Embodiment 1 of the present invention.
Figure 4:
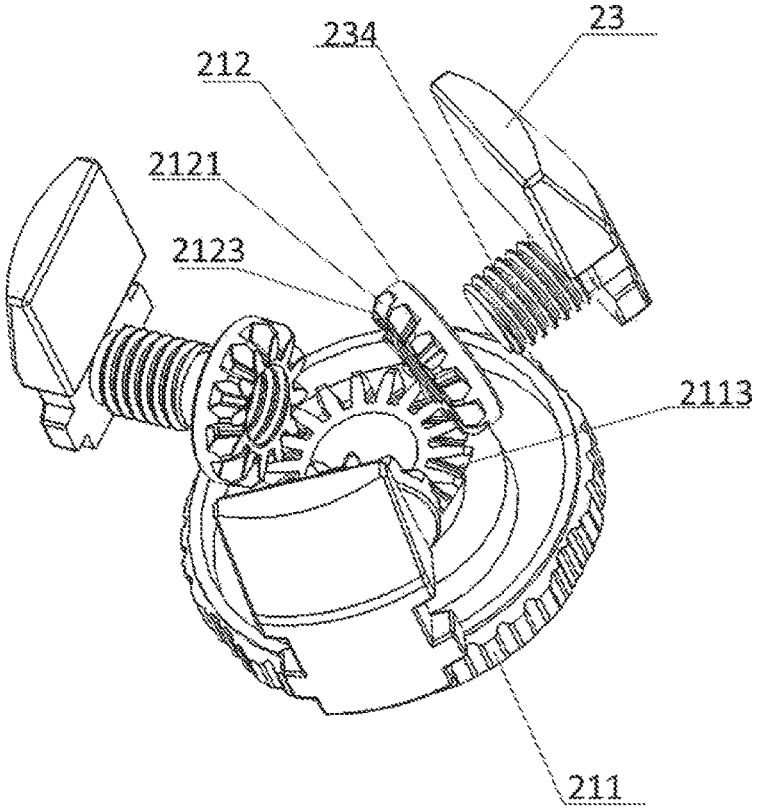
FIG. 4 illustrates another arrangement of the adjusting device and the jaws in Embodiment 1 of the present invention.

The structure of the working portion 20 of the adjustable wrench in this embodiment is as shown in FIGS. 2 and 3, which includes a base 22, jaws 23, a reversing device 24 and an adjusting device 21. The head portion 11 of the handle 10 are connected to the base 22, in which the base 22 is selectively actuated to rotate in a first direction or a second direction about its axis by the reversing device 24 and in the other direction slipping occurs, in which the first direction is clockwise direction or counterclockwise direction, the second direction being opposed to the first direction. A groove portion 224 is provided on the base 22. The groove portion 224 can fit with the jaw 23 so that the jaw 23 can slide along the groove portion 224, for example, the jaw 23 may be configured to be I-shaped to be embedded in the base 22. The adjusting device 21 is used to adjust the position of the jaw 23 on the groove portion 224. In particular, the adjusting device 21 in this embodiment includes a knob 211 and a connecting member 212. The connecting member 212 includes a proximal end 2121 having a tapered toothed surface 2123 and a distal end 2122 having external thread. The connecting member 212 is passed through the jaw 23 and in threaded connection with the jaw 23 by the distal end 2122. The lower end surface 2113 of the knob 211 is a tooth shaped structure. The tapered toothed surface 2123 of the proximal end 2121 of the connecting member 212 engages with the lower end surface 2113 of the knob 211, so that the connecting member 212 actuates the jaw 23 to move along the groove portion 224 when the knob 211 rotates. The knob 211 may also remain coaxial with the base 22 by a positioning pin 225, which improves the stability when the knob 211 adjusts the jaw 23 to move. In a further embodiment (see FIG. 4), the jaw 23 may be configured with a stem portion 234 having external thread. The stem portion 234 of the jaw 23 is passed through the connecting member 212 and is connected to the connecting member 212 by thread. The proximal end 2121 of the connecting member 212 has a tapered toothed surface, engaged with the tooth shaped structure on the lower end surface 2113 of the knob 211, so that the connecting member 212 actuates the jaw 23 to move along the groove portion 224 when the knob 211 rotates.

For convenience in use, in this embodiment, the knob 211 is configured with two ridges protruding from the surface of the knob 211. In use, rotational torque may be applied to the two ridges to rotate the knob 211. In a further embodiment, the outer peripheral surface of the knob 211 may also be configured to a surface suited for gripping, that is, to rotate the knob 211 by gripping the outer peripheral surface of the knob 211.

Figure 5:
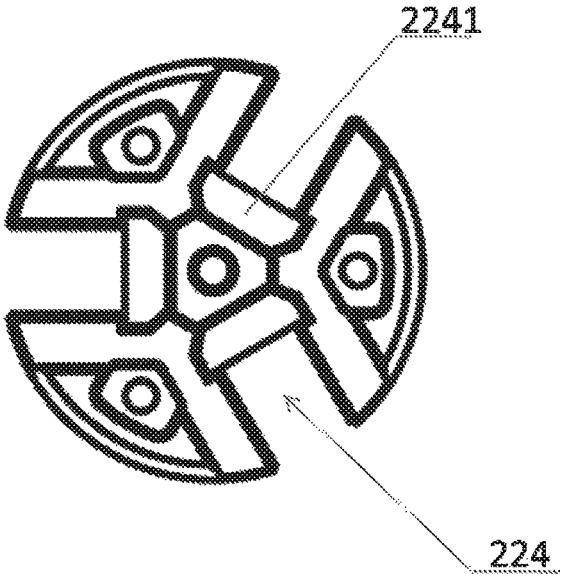
FIG. 5 is a sectional view of the second rotary member in Embodiment 1 of the present invention, taken along A-A.

The base 22 in this embodiment includes a first rotary member 221 and a second rotary member 222, in which the groove portion 224 of the base 22 is located on the second rotary member 222, and the first rotary member 221 is in fixed connection with the second rotary member 222 by bolt. The outer peripheral surface of the first rotary member 221 includes a ratchet surface. As shown in FIG. 5 is a sectional view of the second rotary member 222 taken along A-A, in which the groove portion 224 is central symmetrically distributed on the second rotary member 222, the width of the end portion 2241 near the center being larger than that of the other end, for accommodating the proximal end 2121 of the connecting member 212. In a further embodiment, the base 22 may also be an integral member, that is, part of the outer peripheral surface of the base 22 is a ratchet surface.

Figure 6:
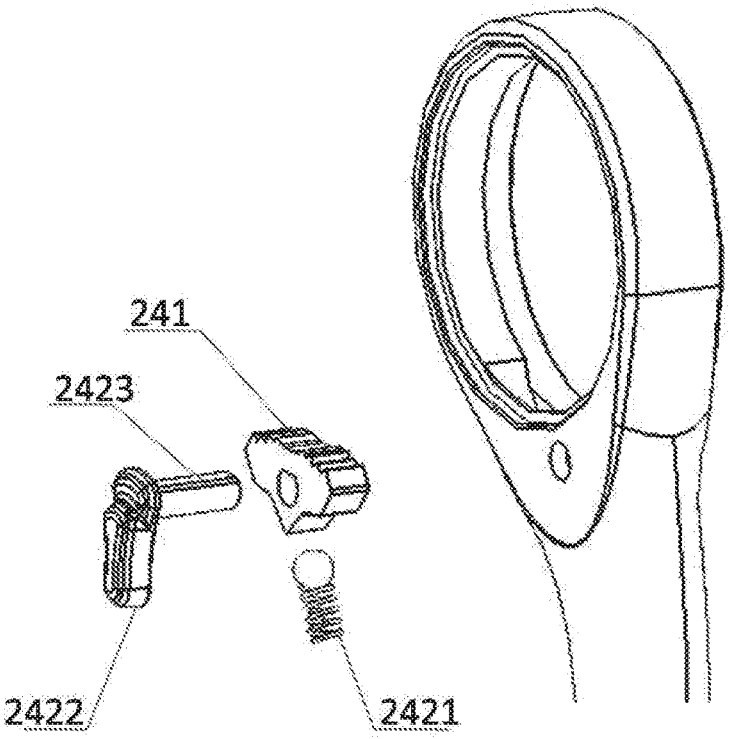
FIG. 6 illustrates a reversing device inside the adjustable wrench in Embodiment 1 of the present invention.

The structure of the reversing device 24 in this embodiment is as shown in FIG. 6, which includes a reversing switch 242 comprising a switch paddle 2422 and a blocking member 2421, and a pawl element 241, in which the pawl element 241 and the blocking member 2421 are located inside a first space 113 and a second space 114 (see FIG. 7) of the handle 10, respectively. A rotary shaft 2423 is provided on the switch paddle 2422, passing through the handle 10 and connected to the pawl element 241. The switch paddle 2422 and the pawl element 241 are synchronously rotatable about the axis of the rotary shaft 2423.

The applicant has disclosed the structure and working principle of the pawl element 241 in PCT/CN2013/070641, that is, the pawl element 241 in this embodiment together with the first rotary member 221 and the reversing switch 242 forms a ratchet component, realizing the ratcheting function of the adjustable wrench, and switching the rotary direction by the reversing switch 242. For other ratchet element structures one may also make reference to the ratchet elements disclosed in U.S. Pat. No. 6,789,447 B1, U.S. Pat. No. 7,587,961 B1 or GB 2,041,272 A.

Figure 7:
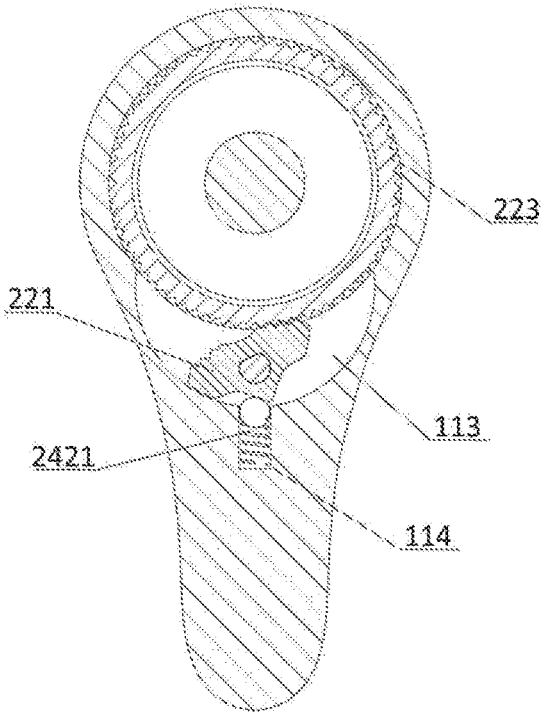
FIG. 7 is a cross-section view of the reversing device of the adjustable wrench in Embodiment 1 of the present invention.
Figure 8:
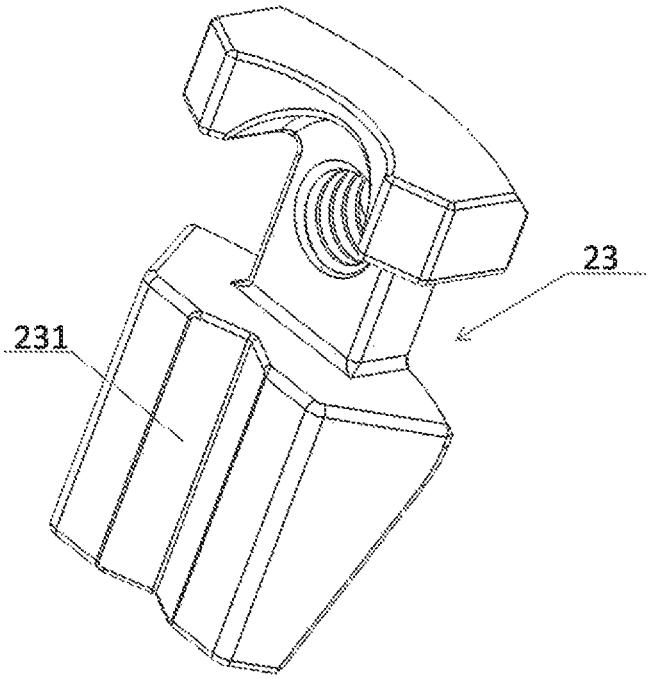
FIG. 8 illustrates a jaw and the clamping surface thereof in Embodiment 1 of the present invention.

As shown in FIG. 8, the jaw 23 in this embodiment is I-shaped, for fitting with the groove portion 224 of the base 22. The jaw 23 also includes a clamping surface 231, selectively configured as an inner side surface or outer side surface depending on the structure of the fastener. For instance, the clamping surface 231 of the jaw 23 in this embodiment is an inner side surface, for fitting with the outer corner fastener. As aforementioned, the jaw 23 is movable on the groove portion 224 of the base 22, and the clamping surfaces 231 of the plurality of jaws 23 constitutes a jaw opening for clamping a fastener, the distance from a clamping surface 231 to the center of the jaw opening being the radial of the jaw opening. The clamping surface 231 may be provided with a specific shape, such as a V-shaped surface as shown in FIG. 7, for fitting with the edges of a workpiece.

Embodiment 2

Figure 9:
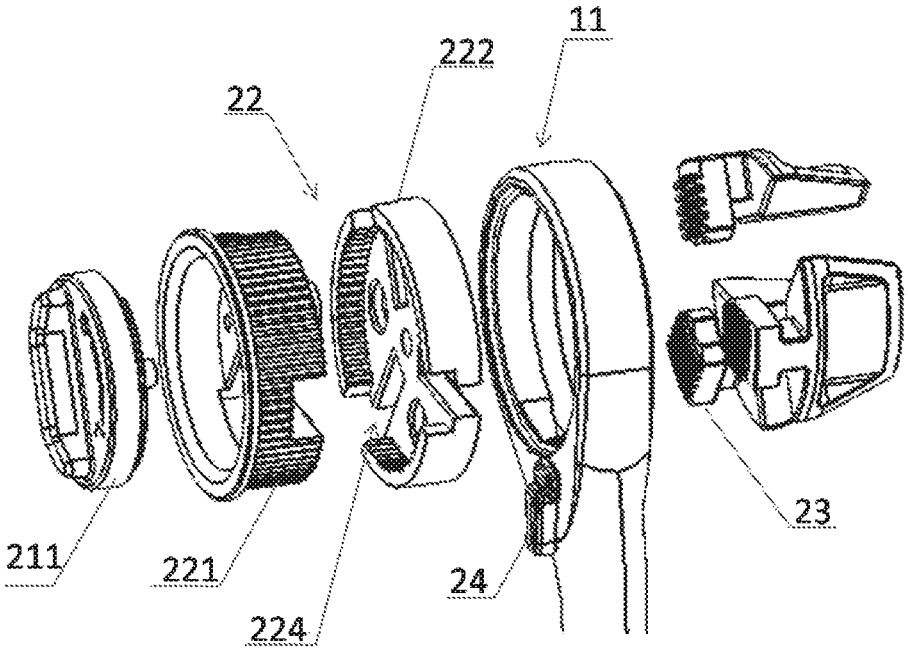
FIG. 9 illustrates a working portion of the adjustable wrench in Embodiment 2 of the present invention.

As the adjustable wrench in Embodiment 1, in this embodiment, the structure of the working portion 20 of the adjustable wrench is as shown in FIG. 9, which includes a base 22, jaws 23, a reversing device 24 and a knob 211, in which the base 22 includes a first rotary member 221 and a second rotary member 222. The first rotary member 221 and the second rotary member 222 have a outer toothed surface and an inner toothed surface that are fitted with each other, respectively, so that the first rotary member 221 can actuate the second rotary member 222 to rotate about its axis. The head portion 11 of the handle 10 is connected to the base 22, in which the base 22 is selectively actuated to rotate in a first direction or a second direction about its axis by the reversing device 24 and in the other direction slipping occurs, in which the first direction is clockwise direction or counterclockwise direction, the second direction being opposed to the first direction. A groove portion 224 is provided on the base 22. The groove portion 224 can fit with the jaw 23 so that the jaw 23 can slide along the groove portion 224. In this embodiment, preferably, there are three pairs of jaws 23 distributed along the circumferential direction of the working portion 20.

Figure 10:
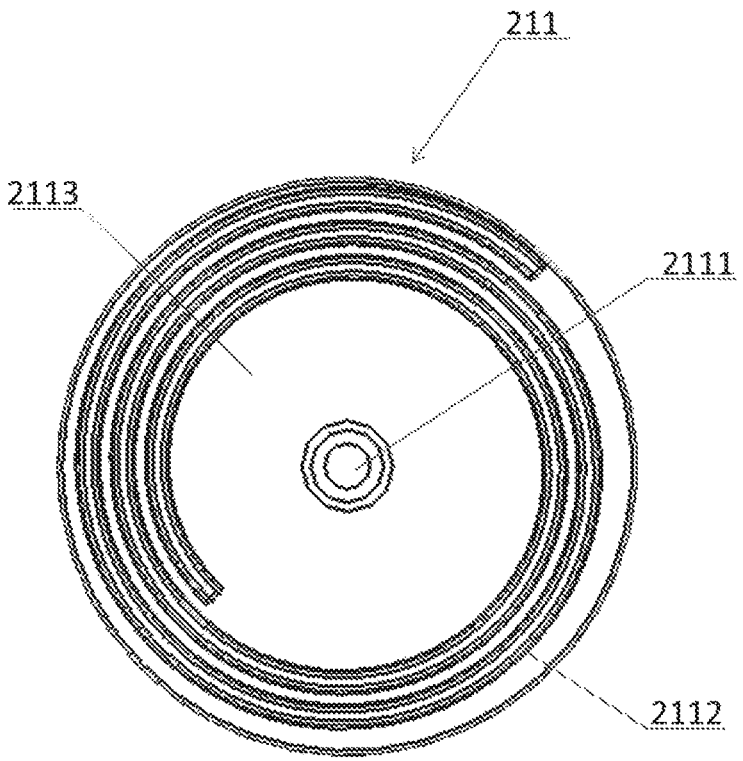
FIG. 10 is a bottom view of the knob of FIG. 9.
Figure 11:
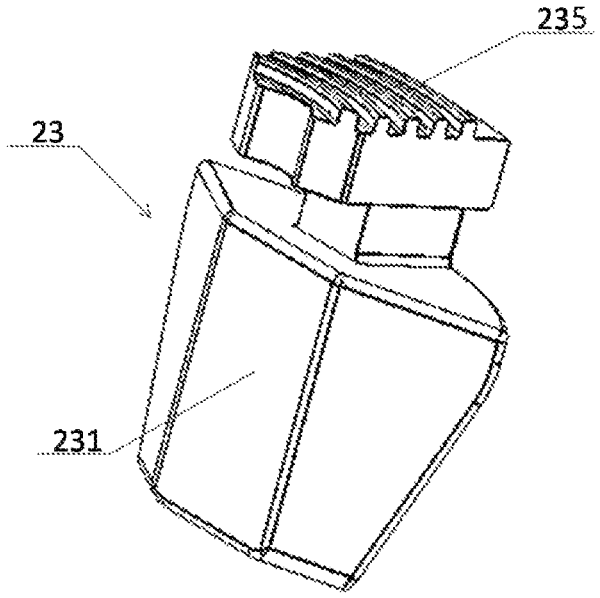
FIG. 11 is a perspective view of the jaw of FIG. 9.

FIGS. 10-11 illustrate the bottom view of the knob 211 and the perspective view of the jaw 23 in this embodiment. It can be seen from FIG. 10 that a stem portion 2111 is provided at the center of the lower end surface 2113 of the knob 211, extending toward the first rotary member 221 and passing through the first rotary member 221 and the second rotary member 222, enabling the knob 211 to be remained coaxial with the first rotary member 221 and the second rotary member 222. The lower end surface 2113 of the knob 211 has a planar thread structure 2112, the projection thereof on the lower end surface 2113 of the knob 211 being a planer spiral line which may be one group, two groups or more groups, preferably in this embodiment one group. The upper end surface 235 of the jaw 23 comes into contact with the lower end surface 2113 of the knob 211. The upper end surface 235 of the jaw 23 as shown in FIG. 11 has an arcuate tooth shaped structure, which fits with the planer thread structure 2112 of the lower end surface of the knob 211 so that slipping occurs relative to the jaw 23 when the knob 211 rotates about the axis. In particular, the jaw 23 will come closer to or away from the center of the knob 211 when the knob 211 rotates in the first direction or the second direction. For convenience in use, in this embodiment, two ridges protruding from the surface of the knob 211 are provided on the knob 211. In use, rotational torque may be applied to the two ridges to rotate the knob 211.

The structure of the reversing device 24 in this embodiment is consistent with that in Embodiment 1, as shown in FIG. 6, including a reversing switch 242 comprising a switch paddle 2422 and a blocking member 2421, and a pawl element 241. The pawl element 241 in this embodiment together with the first rotary member 221 and the reversing switch 242 forms a ratchet component, realizing the ratcheting function of the adjustable wrench, and switching the rotary direction by the reversing switch 242.

The clamping surface 231 of the jaw 23 in this embodiment can selectively be configured as an inner side surface or outer side surface depending on the structure of the fastener. As shown in FIG. 11, the clamping surface 231 of the jaw 23 in this embodiment is configured as an inner side surface, and the clamping surface 231 is a planar surface.

The foregoing described the preferred embodiments of the present invention. It should be understood that an ordinary one skilled in the art can make many modifications and variations according to the concept of the present invention without creative work. Therefore, any person skilled in the art can get any technical solution through logical analyses, deductions and limited experiments, which should fall in the protection scope defined by the claims.

The invention claimed is:

1. An adjustable wrench, comprising a handle and a working portion, the handle has a first end and a second end opposite the first end, the second end has a head portion for receiving the working portion, the working portion comprises at least two jaws distributed in a circumferential direction along the working portion and extending along an axial direction of the working portion, wherein the adjustable wrench further comprises an adjusting device configured to adjust the jaws so as to enable the jaws to move simultaneously in a radial direction of the working portion, closer to or away from the center of the working portion; the working portion further comprises a base, the jaws being configured to be slidable on the base, the jaws having a clamping surface; the handle actuating the base to rotate, the base actuating the jaws to rotate about the axis of the base, the jaws outputting torque by the clamping surface; wherein a groove portion is provided on the base, the groove portion being configured to be able to fit with the jaws, so that the jaws are movable along the groove portion; wherein the adjusting device comprises a knob and a connecting member, the knob being coaxial with the base, the direction of the connecting member being perpendicular to the axis of the knob, the knob and the connecting member having tapered toothed surfaces that can fit with each other, the knob driving the connecting member to rotate by the tapered toothed surface; the connecting member passing through the jaws, wherein the outer thread of the connecting member fits with the inner threads of the jaws so that the jaws are actuated to move along the groove portion when the connecting member rotates.

2. The adjustable wrench as claimed in claim 1, wherein the working portion further comprises a reversing device, the reversing device comprising:

a pawl element fitting with the teeth of a ratchet surface of the base, so that the pawl element can selectively actuate the base to rotate in a first direction or a second direction, and to slip in the other direction, the first direction being clockwise direction or counterclockwise direction, the second direction being opposed to the first direction;

a reversing switch for switching the direction in which the pawl element actuates the base to rotate;

the handle having a first space for accommodating the reversing device.

3. The adjustable wrench as claimed in claim 2, wherein the reversing switch comprises a spring and a blocking member, the handle having a second space for accommodating the spring, the second space connecting with the first space at the side facing toward the working portion, the blocking member fitting with the pawl element, the spring applying pre-tightening force to the pawl element by the blocking member.

4. The adjustable wrench as claimed in claim 3, wherein the spring is arranged inside the blocking member; and the reversing switch further comprises a switch paddle connected to the pawl element.

5. The adjustable wrench as claimed in claim 2, wherein the base comprises a first rotary member and a second rotary member, the first rotary member and the second rotary member being connected by bolt, the first rotary member having a ratchet surface fitting with the pawl element, the groove portion being located on the second rotary member.

6. The adjustable wrench as claimed in claim 1, wherein a lower edge of the inner side surface of the handle limits the jaw in the groove portion.

7. An adjustable wrench, comprising a handle and a working portion, the handle has a first end and a second end opposite the first end, the second end has a head portion for receiving the working portion, the working portion comprises at least two jaws distributed in a circumferential direction along the working portion and extending along an axial direction of the working portion, wherein the adjustable wrench further comprises an adjusting device configured to adjust the jaws so as to enable the jaws to move simultaneously in a radial direction of the working portion, closer to or away from the center of the working portion; the working portion further comprises a base, the jaws being configured to be slidable on the base, the jaws having a clamping surface; the handle actuating the base to rotate, the base actuating the jaws to rotate about the axis of the base, the jaws outputting torque by the clamping surface; wherein a groove portion is provided on the base, the groove portion being configured to be able to fit with the jaws, so that the jaws are movable along the groove portion; wherein the adjusting device comprises a knob and a connecting member, the knob and the base being coaxial, the axis of the connecting member being perpendicular to the axis of the knob, the knob and the connecting member having tapered toothed surfaces that can fit with each other, the jaw having a stem portion, the stem portion having an outer thread fitting with the connecting member, the jaw being actuated to move along the groove portion when the connecting member rotates.

8. The adjustable wrench as claimed in claim 7, wherein the working portion further comprises a reversing device, the reversing device comprising:

a pawl element fitting with the teeth of a ratchet surface of the base, so that the pawl element can selectively actuate the base to rotate in a first direction or a second direction, and to slip in the other direction, the first direction being clockwise direction or counterclockwise direction, the second direction being opposed to the first direction;

a reversing switch for switching the direction in which the pawl element actuates the base to rotate;

the handle having a first space for accommodating the reversing device.

9. The adjustable wrench as claimed in claim 8, wherein the reversing switch comprises a spring and a blocking member, the handle having a second space for accommodating the spring, the second space connecting with the first space at the side facing toward the working portion, the blocking member fitting with the pawl element, the spring applying pre-tightening force to the pawl element by the blocking member.

10. The adjustable wrench as claimed in claim 9, wherein the reversing switch comprises a spring and a blocking member, the handle having a second space for accommodating the spring, the second space connecting with the first space at the side facing toward the working portion, the blocking member fitting with the pawl element, the spring applying pre-tightening force to the pawl element by the blocking member.

11. The adjustable wrench as claimed in claim 8, wherein the base comprises a first rotary member and a second rotary member, the first rotary member and the second rotary member being connected by bolt, the first rotary member having a ratchet surface fitting with the pawl element, the groove portion being located on the second rotary member.

12. The adjustable wrench as claimed in claim 7, wherein a lower edge of the inner side surface of the handle limits the jaw in the groove portion.

13. An adjustable wrench, comprising a handle and a working portion, the handle has a first end and a second end opposite the first end, the second end has a head portion for receiving the working portion, the working portion comprises at least two jaws distributed in a circumferential direction along the working portion and extending along an axial direction of the working portion, wherein the adjustable wrench further comprises an adjusting device configured to adjust the jaws so as to enable the jaws to move simultaneously in a radial direction of the working portion, closer to or away from the center of the working portion; the working portion further comprises a base, the jaws being configured to be slidable on the base, the jaws having a clamping surface; the handle actuating the base to rotate, the base actuating the jaws to rotate about the axis of the base, the jaws outputting torque by the clamping surface; wherein a groove portion is provided on the base, the groove portion being configured to be able to fit with the jaws, so that the jaws are movable along the groove portion; wherein the adjusting device is a knob, the lower end surface of the knob having a planar thread structure, the upper end surface of the jaw having an arcuate toothed surface, the planar thread structure fitting with the arcuate toothed surface so that the jaw is actuated to move along the groove portion when the knob rotates.

14. The adjustable wrench as claimed in claim 13, wherein the working portion further comprises a reversing device, the reversing device comprising:

a pawl element fitting with the teeth of a ratchet surface of the base, so that the pawl element can selectively actuate the base to rotate in a first direction or a second direction, and to slip in the other direction, the first direction being clockwise direction or counterclockwise direction, the second direction being opposed to the first direction;

a reversing switch for switching the direction in which the pawl element actuates the base to rotate;

the handle having a first space for accommodating the reversing device.

15. The adjustable wrench as claimed in claim 14, wherein the reversing switch comprises a spring and a blocking member, the handle having a second space for accommodating the spring, the second space connecting with the first space at the side facing toward the working portion, the blocking member fitting with the pawl element, the spring applying pre-tightening force to the pawl element by the blocking member.

16. The adjustable wrench as claimed in claim 15, wherein the reversing switch comprises a spring and a blocking member, the handle having a second space for accommodating the spring, the second space connecting with the first space at the side facing toward the working portion, the blocking member fitting with the pawl element, the spring applying pre-tightening force to the pawl element by the blocking member.

17. The adjustable wrench as claimed in claim 14, wherein the base comprises a first rotary member and a second rotary member, the first rotary member and the second rotary member being connected by bolt, the first rotary member having a ratchet surface fitting with the pawl element, the groove portion being located on the second rotary member.

18. The adjustable wrench as claimed in claim 13, wherein a lower edge of the inner side surface of the handle limits the jaw in the groove portion.

* * * * *